US010908522B2

(12) United States Patent
Varnell

(10) Patent No.: US 10,908,522 B2
(45) Date of Patent: Feb. 2, 2021

(54) TREATMENT OF PRINTING SUBSTRATE

(71) Applicant: SOLENIS TECHNOLOGIES, L.P., Wilmington, DE (US)

(72) Inventor: Daniel F. Varnell, Wilmington, DE (US)

(73) Assignee: Solenis Technologies, L.P., Wilmington, DE (US)

( * ) Notice: Subject to any disclaimer, the term of this patent is extended or adjusted under 35 U.S.C. 154(b) by 267 days.

(21) Appl. No.: 15/979,084

(22) Filed: May 14, 2018

(65) Prior Publication Data

US 2018/0335711 A1 Nov. 22, 2018

Related U.S. Application Data

(60) Provisional application No. 62/507,741, filed on May 17, 2017.

(51) Int. Cl.

| | |
|---|---|
| ***G03G 7/00*** | (2006.01) |
| ***G03G 17/08*** | (2006.01) |
| ***G03G 15/10*** | (2006.01) |
| ***G03G 15/16*** | (2006.01) |

(52) U.S. Cl.

CPC ..... *G03G 7/0026* (2013.01); *G03G 7/004* (2013.01); *G03G 15/10* (2013.01); *G03G 15/104* (2013.01); *G03G 15/1695* (2013.01); *G03G 17/08* (2013.01); *G03G 2215/00801* (2013.01)

(58) Field of Classification Search

CPC ..... G03G 7/0026
USPC ..... 399/390
See application file for complete search history.

(56) References Cited

U.S. PATENT DOCUMENTS

| | | | | |
|---|---|---|---|---|
| 4,833,503 | A | 5/1989 | Snelling | |
| 7,008,979 | B2 | 3/2006 | Schottman et al. | |
| 8,795,818 | B2 * | 8/2014 | Wang | B41M 5/52 428/206 |
| 9,244,393 | B1 * | 1/2016 | Inaba | G03G 15/2021 |
| 2005/0245651 | A1 | 11/2005 | Cooper | |
| 2005/0266184 | A1 * | 12/2005 | Kobayashi | G03G 7/0046 428/32.38 |
| 2007/0031615 | A1 | 2/2007 | Nair et al. | |
| 2011/0104441 | A1 * | 5/2011 | Bhattacharyya | B05D 3/007 428/143 |
| 2012/0058317 | A1 * | 3/2012 | Seung | B41M 5/5272 428/201 |
| 2012/0141181 | A1 * | 6/2012 | Bisaiji | G03G 15/6564 399/390 |
| 2013/0216808 | A1 * | 8/2013 | Kozlowski | G03G 7/0046 428/218 |
| 2013/0224395 | A1 * | 8/2013 | Regnier | C09D 5/002 427/535 |
| 2016/0282737 | A1 | 9/2016 | Hood et al. | |
| 2017/0335115 | A1 | 11/2017 | Seshadri et al. | |
| 2017/0336725 | A1 * | 11/2017 | Varnell | C09D 123/0869 |

FOREIGN PATENT DOCUMENTS

| | | | |
|---|---|---|---|
| EP | 2426176 | A1 | 3/2012 |
| WO | 2014160604 | A1 | 10/2014 |
| WO | 2017201032 | A1 | 11/2017 |
| WO | 2017201211 | A1 | 11/2017 |

OTHER PUBLICATIONS

ISA USPTO, International Search Report and Written Opinion issued in International Application No. PCT/US2018/032572, dated Jul. 31, 2018.

* cited by examiner

*Primary Examiner* — Anthony H Nguyen
(74) *Attorney, Agent, or Firm* — Lorenz & Kopf, LLP

(57) ABSTRACT

A method of enhancing adhesion of an image to at least one surface of a substrate is provided herein. The method includes treating at least a portion of the surface by applying a composition comprising one or more polymers to the portion of the surface. The method further includes drying the composition after applying the composition to the substrate to form a treated substrate. The method further includes printing an image from an electrophotographic printer utilizing liquid toner technology on the treated substrate. The substrate is treated and dried less than about 5 minutes prior to being printed.

20 Claims, No Drawings

TREATMENT OF PRINTING SUBSTRATE

CROSS-REFERENCE TO RELATED APPLICATION

This application claims the benefit of U.S. Provisional Application No. 62/507,741, filed May 17, 2017, which is incorporated herein by reference in its entirety.

TECHNICAL FIELD

The presently disclosed method(s) and product(s), relate generally to a method of enhancing adhesion of a liquid toner to at least one surface of a substrate, comprising: (i) treating a printable substrate just before printing with a composition comprising a polymer; (ii) drying the treated substrate; and (iii) liquid electrophotographic printing an image on the treated substrate using a liquid toner ink. The present disclosure also relates generally to a printed substrate produced by such a method.

BACKGROUND

Liquid electrophotographic (LEP) printing uses a liquid ink for printing on substrates rather than using a dry, powder toner. Common examples of LEP printing machines are the HP® digital Indigo™ printing presses. The toner particles in the liquid ink used in LEP printing are sufficiently small such that the LEP-printed images do not mask the underlying surface roughness/gloss of, for example, paper substrates. The liquid ink (also referred to herein as "ink", "liquid toner", or "LEP ink") used in LEP printing is a suspension of small pigment particles in the range of about 1 to 2 microns in a nonaqueous liquid. HP® ElectroInk® is a commonly used liquid ink for liquid electrophotographic printing. Pigment particles can mean pigment dispersed in polymer. LEP printing is considered to give some of the best digital print quality images at a relatively rapid speed.

However, it has been found that oftentimes LEP printed images will not adhere to substrates as well as images printed using electroreprographic printing methods that utilize a dry-toner process. Therefore, a need exists to enhance the adhesion of LEP ink on substrates via the LEP printing process.

BRIEF SUMMARY

A method of enhancing adhesion of an image to at least one surface of a substrate is provided herein. The method includes, but is not limited to, treating at least a portion of the surface by applying a composition comprising one or more polymers to the portion of the surface. The method further includes, but is not limited to, drying the composition after applying the composition to the substrate to form a treated substrate. The method further includes, but is not limited to, printing an image from an electrophotographic printer utilizing liquid toner technology on the treated substrate. The substrate is treated and dried less than about 5 minutes prior to being printed. A printed material is also provided herein. The printed material includes, but is not limited to, a surface treated substrate including a print receiving coating. The print receiving coating is coated on at least a portion of at least one side of the substrate. The print receiving coating includes, but is not limited to, one or more polymers. The printed material further includes, but is not limited to, an image on at least a portion of the print receiving coating. The image is printed on the print receiving coating from an electrophotographic printer utilizing liquid toner technology. The substrate is coated less than about 5 minutes prior to the image being printed.

DETAILED DESCRIPTION

The following detailed description is merely exemplary in nature and is not intended to limit the disclosure or the application and uses of the subject matter as described herein. Furthermore, there is no intention to be bound by any theory presented in the preceding background or the following detailed description.

Further, the following description provides specific details, such as materials and dimensions, to provide a thorough understanding of the present disclosure. The skilled artisan, however, will appreciate that the present disclosure can be practiced without employing these specific details. Indeed, the present disclosure can be practiced in conjunction with processing, manufacturing, or fabricating techniques conventionally used in the printing industry. Moreover, the processes below describe only steps, rather than a complete process flow, for forming the substrate including the composition for enhancing adhesion of an image according to the present disclosure.

As used herein, "a," "an," or "the" means one or more unless otherwise specified. The term "or" can be conjunctive or disjunctive. Open terms such as "include," "including," "contain," "containing" and the like mean "comprising." The term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated. As used herein, the "%" described in the present disclosure refers to the weight percentage unless otherwise indicated. As used herein, the phrase "substantially free of" means that a composition contains little no specified ingredient/component, such as less than about 1 wt %, 0.5 wt %, or 0.1 wt %, or below the detectable level of the specified ingredient. Unless stated otherwise, molecular weight of a polymer refers to weight average molecular weight.

As used herein, "liquid electrophotographic printing" can be used interchangeably with "LEP printing", "electroreprographic printing with liquid toner particles", or "xerographic printing with liquid toner particles"; all of which encompass, for example, HP® digital Indigo printing presses and processes. Further, as used herein, liquid electrophotographic printing does not refer to or encompass the offset type printing process known as lithography and discussed in more detail in Alex Glassman, Printing Fundamentals, TAPPI Press, 1985, which is hereby incorporated herein in its entirety.

As will be understood by persons of ordinary skill in the art, the liquid electrophotographic printing methods disclosed herein use liquid electrophotographic printing machines, also referred to as, for example, LEP printing machines and digital LEP printers. Well-known commercial examples of LEP printing machines are HP® digital indigo printing presses, also referred to as Indigo printers or variations of such.

As used herein, the term "polymer solution" means that the polymer or some portion of the polymer is soluble in water or alkaline or acidic water solutions "Rheology modifier" refers to chemistry that alters the viscosity of a solution or the viscosity vs shear response of a solution.

Unless otherwise specified herein, the term "polymer", as used in the present disclosure, is a polymer comprising one or more different monomeric units, which can encompass, for example, copolymers and terpolymers. The one or more polymers used in the present disclosure are polymer solutions.

The term "coating", as used herein, is a film or uniform application of material applied to at least a portion of at least one surface of a substrate and can comprise one or more components as would be known by a person of ordinary skill in the art to be beneficial in coating a substrate (e.g., a paper substrate and/or a plastic-containing substrate) to enhance the substrate and/or the print quality of an image printed thereon. However, coating as applied to "coated paper" has a meaning of paper treated on the surface with a combination of fillers and binder as defined See David Saltman, et al., Pulp & Paper Primer, 2nd Edition, TAPPI Press (1998) at, for example but without limitation, pages 24-25, which is hereby incorporated by reference herein in its entirety.

The current disclosure concerns treatment of substrates that are ready for printing by other means, but are then modified, post manufacturing, by applying a composition to the substrate and, in embodiments, just prior to printing, to improve adhesion of liquid toner printed images. For instance if the substrate is paper, the composition is applied to the paper product after the paper has been removed from the paper machine. The composition comprises one or more polymers wherein the total one or more polymers comprise, by dry weight, greater than about 50%, alternatively greater than 70% of the composition. Probably the treatment is as part of the printing process on the printing machine. It has been surprisingly found that the composition used in the treatment does not require a binder to which the one or more polymers used in the disclosure is added to provide the desired adhesion of printed images. Furthermore, it was surprising that the one or more polymers used in the current disclosure may be applied to the substrate just prior to or even as part of the printing process, wherein the total amount of the one or more polymers comprises, by dry weight, greater than about 50%, alternatively greater than about 70% of the composition and as such it provides easy handling and a convenient process by which substrates ready for printing may be treated to obtain improved adhesion of images. The present disclosure provides a method of enhancing the adhesion of liquid toner ink printed on at least a portion of at least one surface of a substrate using a digital LEP printer. The present disclosure also provides for one or more printed products that have been produced by the presently disclosed method.

The present disclosure provides a method of enhancing adhesion of a liquid toner to at least one surface of a substrate, comprising: (i) treating a printable substrate before printing, in embodiments, less than about 5 minutes before printing, or less than about 1 minute, or less than about 30 seconds before printing, by applying a composition comprising one or more polymers and optionally a rheology modifier, (ii) drying the composition after applying the composition to the substrate to for a treated substrate; and (iii) liquid electrophotographic printing an image on the treated substrate using a liquid ink. The present disclosure also relates generally to a printed substrate produced by such a method.

The composition comprises one or more polymers, the one or more polymers comprise a repeat unit, wherein the repeat unit has a localized strong, negatively charged dipole (such as a carbonyl group) and no strongly positively charged dipole. As used herein, "localized strong, negatively charged dipole" means there is in the structure of the repeat unit a functional group, such as a carboxyl group, and herein "strong" is defined as having a local dipole moment of great than 2 debyes, where a carbonyl group is known to have a dipole of about 2.4 debyes in magnitude, the local dipole arising from differences in electronegativity of atoms bound together. Herein, having "no strongly positively charged dipole means there is no localized dipole (such as from a hydroxyl group) that has a dipole greater than 0.8 debyes in magnitude.

The repeat unit can comprise, for example but without limitation, a carbonyl group.

The composition can comprise one or more polymers having at least one repeat unit comprising a tertiary amide group, wherein (i) at least one of the carbon atoms bonded to the nitrogen atom of the tertiary amide group has two or three hydrogen atoms bonded thereto, and (ii) the carbonyl group of the tertiary amide group is bonded to a —CH, —CH2, or —CH3 group.

The one or more polymers used in the treatment comprise one or more polymers produced from one or more monomers wherein at least one of the one or more monomers for each of the one or more polymers is selected from the group of vinylpyrrolidone, an oxazoline-containing monomer, N-vinyl piperidinone (also known as N-vinyl piperidone), N-vinylcaprolactam, N,N-dimethyl acrylamide, and combinations thereof. The one or more polymers may be homopolymers, copolymers, or a combination thereof. For example, the one or more polymers used in the treatment may be one or more homopolymers and comprise one or more polymers produced from one or more monomers wherein the monomer for each of the one or more polymers is selected from the group of vinylpyrrolidone, an oxazoline-containing monomer, N-vinyl piperidinone (also known as N-vinyl piperidone), N-vinylcaprolactam, and N,N-dimethyl acrylamide.

The one or more polymers can further comprise one or more non-ionic monomeric units. For example, it can comprise one or more polymers produced utilizing (i) at least one of one or more monomers selected from the group of vinylpyrrolidone, an oxazoline-containing monomer, N-vinyl piperidinone, N-vinylcaprolactam, N,N-dimethyl acrylamide, and combinations thereof for each of the one or more polymers; and (ii) one or more non-ionic monomers. Non-limiting examples of the oxazoline-containing monomer are 2-ethyl-2-oxazoline and/or 2-methyloxazoline. Once again, the one or more polymers may be homopolymers and each of the one or more polymers may be produced from one monomer selected from the group of 2-ethyl-2-oxazoline and 2-methyloxazoline. As used herein, a non-ionic monomer is one that does not have an anionic or cationic functionality under the conditions of use—such as from an acrylic acid, methacrylic acid, quaternary amine containing monomers. The one or more polymers can further comprise one or more monomeric units that do not strongly lead to hydrogen bonding with the primary polymer of the treatment, for the purposes of the current disclosure they do not lead to a strong degree of self-association within the polymer. For the current disclosure strong self-association means significant hydrogen bonding of the polymer with itself or a high degree of dipole-dipole interactions of the polymer with itself. For a discussion of interaction between monomer units in a polymer, and one polymer with another polymer or with a solvent, refer to Chapter 12 of Paul Flory's classic work "Principles of Polymer Chemistry, first published in 1953 by Cornell Press. He defined an interaction parameter that expressed "the first neighbor interaction free energy." Others have expanded greatly on the concept since Flory's work. Those familiar with the concept will recognize that the point being made here is that the polymers of this disclosure have the trait of having little self-association, on a relative basis, versus other polymers and more importantly (although not meaning to be bound by theory), they are polymers that will interact on a molecular level more strongly with the polymer of the liquid toner than with themselves. It is therefore also understood that small amounts of other co-monomers, such as less than 5%, could be incorporated into the one or more polymers without changing the predominant characteristic imparted to the substrate by the one or more polymers.

In one embodiment, the at least one of the one or more polymers comprises at least one of poly(2-ethyl-2-oxazoline) and poly(2-methyloxazoline). In another embodiment the at least one or the one or more polymers has as the primary repeat unit based on vinylpyrrolidone.

Each of the one or more polymers can have a number average molecular weight greater than about 40,000 Daltons, or greater than about 80,000 Daltons, or greater than about 190,000 Daltons, or greater than about 450,000 Daltons, wherein the upper boundary is a molecular weight that would prevent the formation of a solution comprising the one or more polymers, as would be recognized by a person of ordinary skill in the art. In certain embodiments, the upper boundary is less than about 2,000,000 Daltons.

Rheology modifiers can be added to the composition containing the one or more polymers to adjust the viscosity of the composition to obtain a functional viscosity that can be applied to the substrate by methods know to those in the art.

The substrate can be selected from the group of paper products, woven and/or non-woven fibrous materials, plastic-based materials (also referred to herein simply as "plastic (s)"), and combinations thereof. The substrate must be printable by some means prior to treatment and be capable of being treated per the current disclosure including being dried prior to being printed with a liquid toner based electroreprographic printer.

In one embodiment, the substrate is a paper product which can be in any orientation as would be known by a person of ordinary skill in the art, such as one or more rolls, cut sheets, and/or various shapes and configurations capable of being printed by a digital LEP printer. The substrate can also be any other substrate compatible with the LEP printing process as would be known by a person of ordinary skill in the art.

The amount of the polymer applied to a substrate is dependent on the properties of the substrate. For example, if the substrate is uncoated paper, the composition comprising the one or more polymers may soak into the substrate or may remain on the surface.

The method by which the composition comprising the one or more polymers is applied to a printable surface can impact the amount of the composition applied to the substrate. In such cases, the amount of polymer is reflected herein simply as a measurement of the amount added to the substrate as a weight percent of the substrate. However, for cases where the composition does not soak into the substrate the total amount of the one or more polymers is expressed as how much of it is applied to the surface and the addition level is expressed as weight per the surface area treated. The amounts are based on the total amount of the one or more polymers applied to the substrate not the total composition applied.

Generally when the treated substrate is a paper product or porous or semi-porous substrate, the amount of the one or more polymer added to the treated paper product can be in a range of from about 0.02 to about 1 wt %, or from about 0.03 to about 0.5%, or from about 0.04 to about 0.25%, or from about 0.04 to about 0.1% of the substrate on a dry weight basis. The amounts are based on the total amount of the one or more polymers applied to the substrate not the total composition applied.

The treated substrate can be a relatively non-porous substrate and even paper with a closed surface and the amount of the one or more polymers on each side of the treated substrate can be in a range of from about 0.0075 g/m2 to about 0.375 g/m2, or from 0.0115 g/m2 to about 0.165 g/m2, or from about 0.015 g/m2 to about 0.095 g/m2, or from about 0.015 g/m2 to about 0.04 g/m2 of the substrate on a dry weight basis. The amounts are based on the total amount of the one or more polymers applied to the substrate not the total composition applied.

The composition comprising the one or more polymers can further comprise additional additives for enhancing the adhesion of the liquid toner printed on a substrate. Such additives could be polyethylene imine or a copolymer of ethylene and acrylic acid.

The composition comprising the one or more polymers can also further comprise additional additives as known in the art including, for example, fillers, defoamers, waxes, pigments, dyes, biocides, rheology modifiers, rosin derivatives, surfactants, and/or combinations thereof. The current disclosure has no need of a binder to provide the desired function of providing adhesion of images to the treated substrate, nor is a binder needed for application as is the case when treating paper on a paper machine such as at a size press. The amount of the one or more polymer(s) in the composition by weight used to treat the substrate, on a dry weight basis is at least about 50%, at least about 75%, at least about 80%, at least about 90%, at least about 95%, and at least 98% of the total dry weight of the composition.

The method can further comprise crosslinking the surface treated substrates by any means known in the art, including, for example, adding UV-curable or thermal-curable monomers to the composition comprising the polymer and/or UV curing or thermally curing the surface treated substrates.

The method of the disclosure can utilize any suitable method as would be known to a person of ordinary skill in the art for applying the composition comprising the polymer to a substrate that leads to a substantially uniform treatment across the surface of the substrate or across areas of desired printing. Such methods include, for example but without limitation to spray coating, foam coating, curtain coating, roller coating, transfer coating, printing, and/or combinations thereof.

In one aspect, the present disclosure is directed to a printed substrate produced by any one of the above-recited methods.

In another aspect, the present disclosure is directed to a printed substrate produced by any one of the methods of the disclosure, which may further comprise one or more images printed on the substrate before and/or after the inventive methods. The one or more additional images printed on the substrate can be printed using any printing method/process as would be known to a person of ordinary skill in the art, including, for example but without limitation, inkjet printing.

In embodiments, the image printed on the substrate using the inventive method can have an adhesion to the substrate greater than about 80%, or greater than about 85%, or greater than about 90%, or greater than about 95% as measured by the Tape Pull Test using 3M 230 tape.

Alternatively, any image, a 100% black image, or a 290% composite black image (as used for HP testing) on the printed substrate has an adhesion retention to the treated substrate in an amount of greater than about 80%, alternatively greater than about 85%, alternatively greater than about 90%, or alternatively greater than 95% in accordance with the Tape Pull Test using 3M 230 tape, which is described in greater detail below. In one embodiment, the image formed from a 100% black liquid toner has an adhesion retention to the treated substrate reported to be greater than 90% in accordance with the Tape Pull Test as tested by the Rochester Institute of Technology using a standard HP procedure for the HP Indigo 5500 Press. Currently the test calls for use of 3M 234 tape. It replaces the use of 3M 230 tape and there is built into the procedure corrections for the change in type of tape. In another embodiment the reported adhesion from RIT is greater than 95%. In another embodiment, the image formed from a 290% black liquid toner has an adhesion retention to the treated substrate reported to be of greater than 80% in accordance or reported to be greater than 90% or reported to be greater than 95% by RIT, per the same HP tape test.

The disclosure provides for a printed material comprising: (i) a substrate treated with a composition comprising the polymer treatment of the current disclosure to form a treated substrate; and (ii) an image on at least a portion of one surface of the treated substrate, wherein the image is printed on the treated substrate using a liquid electrophotographic printer and a liquid toner.

EXAMPLES

The following examples illustrate the enhanced adhesion of liquid toner LEP printed on a substrate as disclosed herein compared to the adhesion of LEP ink to substrates previously known in the prior art. These examples are merely illustrative of the present disclosure and are not to be construed as limiting the present disclosure to the particular compounds, processes, conditions, or applications disclosed therein.

Test Method for Measuring Adhesion

The test method used was the standard method for determining adhesion of HP® digital Indigo™ printed images to substrates as defined by HP for qualification of paper for their Indigo presses. More specifically, black rectangle images of 100% black liquid toner were printed using an HP® Indigo 5500 printer in a 4 shot mode using standard temperature settings to provide the test pattern. Black rectangular images were also printed using the same printer and settings but the black liquid toner was composed of 52 parts yellow, 66 parts magenta, 72 parts cyan, and 100 parts black toner, which are commonly referred to as 290% photoimages. The latter test is generally the more severe test.

Ten minutes after printing the above-described images, the images were tested for adhesion to a substrate with a tape test using 3M™ 230 tape and a weighted roller to uniformly and consistently apply force. The percent of the image not removed by peeling off the tape was measured.

The tests were performed by the Rochester Institute of Technology (the North American test site for qualifying paper treatments for indigo printing) in compliance with the standard test procedures set forth by HP for testing the adhesion of ink coated with one of their Indigo printing presses. For these tests, the HP® Indigo press 5500 was used. The current disclosure applies to all liquid toner based HP Indigo printers/presses and they may be used for testing of adhesion in ways known to those skilled in the art.

EXAMPLE 1

Commercial 112 g/m2 alkaline offset printing paper with 19% ash content, a sizing level of 8 seconds by the Hercules Sizing Test (HST), and containing sulfonated optical brightening agent was tested for adhesion of images from an HP 5500 Indigo printer (testing done by Rochester Institute of Technology). The samples were also treated with a solution of 500,000 Daltons average MW Poly-2-ethyl-2oxzaoline (PEtOx) with the amount of polymer treatment being 0.3% and 0.6% on a dry basis of the paper weight. The treatment was applied as a 15% solution and then dried on a drum drier. The % adhesion of 100% black print with the control paper was 84%. With application 0.3% of PEtOx the adhesion improved to 91% and with 0.6% treatment the adhesion was 92%. Therefore, the addition of PEtOx improves the adhesion. No other polymer or rheology modifier was added with the PEtOx.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

What is claimed is:

1. A method of enhancing adhesion of an image to at least one surface of a substrate, the method comprising:

treating at least a portion of the surface by applying a composition comprising one or more water soluble polymers to the portion of the surface, wherein each of the one or more polymers comprises a repeat unit, and wherein the repeat unit comprises a negatively charged dipole moment of greater than 2 debyes, and wherein the repeat unit comprises no positively charged dipole moment of greater than 0.8 debyes;

drying the composition after applying the composition to the substrate to form a treated substrate; and printing an image from an electrophotographic printer utilizing liquid toner technology on the treated substrate;

wherein the substrate is treated and dried less than about 5 minutes prior to being printed;

wherein the composition is free of a polymer of ethylene and acrylic acid and a polymer of ethylene and methacrylic acid; and wherein the composition is free of a binder.

2. The method of claim 1, wherein one or more of the polymers is formed from 2-ethyl-2-oxazoline and/or methyloxazoline.

3. The method of claim 1, wherein each of the one or more polymers comprises at least one repeat unit comprising a tertiary amide group, wherein (i) at least one of the carbon atoms bonded to the nitrogen atom of the tertiary amide group has two or three hydrogen atoms bonded thereto, and (ii) the nitrogen of the tertiary amide group is bonded to a carbonyl group bonded to a —CH, —$CH_2$, or —$CH_3$ group.

4. The method of claim 1, wherein one of the one or more polymers is a homopolymer formed from 2-ethyl-2-oxazoline.

5. The method of claim 1, wherein one of the one or more polymers is a homopolymer formed from 2-methyloxazoline.

6. The method of claim 1, wherein each of the one or more polymers is a homopolymer and has a weight average molecular weight of from about 500,000 to about 2,000,000 Daltons.

7. The method of claim 1, wherein the composition comprises the one or more polymers in an amount of at least about 95%, based on a dry weight of the composition.

8. A printed substrate produced by claim 1.

9. The printed substrate of claim 8, wherein at least one of each of the treated sides of the substrate comprises the one or more polymers in an amount of from about 0.0075 to about 0.375 g/$m^2$, based on a dry weight of the substrate.

10. The printed substrate of claim 8, wherein the image has an adhesion to the substrate of greater than about 90% as measured by the Tape Pull Test using 3M 230 tape.

11. A printed material, comprising:

a surface treated substrate comprising a print receiving coating, wherein the print receiving coating is coated on at least a portion of at least one side of the substrate, wherein the print receiving coating comprises one or more water soluble polymers, wherein the one or more polymers comprises one or more repeat units have a negatively charged dipole of greater than 2 debyes, and have no positively charged dipole of greater than 0.8 debyes; and an image on at least a portion of the print receiving coating, wherein the image is printed on the print receiving coating from an electrophotographic printer utilizing liquid toner technology;

wherein the substrate is coated less than about 5 minutes prior to the image being printed;

wherein the composition is free of a polymer of ethylene and acrylic acid and a polymer of ethylene and methacrylic acid; and wherein the composition is free of a binder.

12. The printed material of claim 11, wherein one or more of the polymers is formed from 2-ethyl-2-oxazoline and/or methyloxazoline.

13. The printed material of claim 11, wherein each of the one or more polymers comprises at least one repeat unit comprising a tertiary amide group, wherein (i) at least one of the carbon atoms bonded to the nitrogen atom of the tertiary amide group has two or three hydrogen atoms bonded thereto, and (ii) the nitrogen of the tertiary amide group is bonded to a carbonyl group bonded to a —CH, —$CH_2$, or —$CH_3$ group.

14. The printed material of claim 11, wherein one of the one or more polymers is a homopolymer formed from 2-ethyl-2-oxazoline.

15. The printed material of claim 13, wherein one of the one or more polymers is a homopolymer formed from 2-methyloxazoline.

16. A method of enhancing adhesion of an image to at least one surface of a substrate, the method comprising:

treating at least a portion of the surface by applying a composition comprising one or more water soluble homopolymers to the portion of the surface, wherein each of the one or more water soluble homopolymers is formed from 2-ethyl-2-oxazoline or methyloxazoline and has a weight average molecular weight of from about 500,000 to about 2,000,000 Daltons;

drying the composition after applying the composition to the substrate to form a treated substrate; and printing an image from an electrophotographic printer utilizing liquid toner technology on the treated substrate;

wherein the substrate is treated and dried less than about 5 minutes prior to being printed;

wherein the composition is free of a polymer of ethylene and acrylic acid and a polymer of ethylene and methacrylic acid; and wherein the composition is free of a binder.

17. The method of claim 16 wherein the composition comprises a single homopolymer.

18. The method of claim 16 wherein the single homopolymer is formed from 2-ethyl-2-oxazoline.

19. The method of claim 18 wherein the single homopolymer has a weight average molecular weight of about 500,000 Daltons.

20. The method of claim 16 wherein the homopolymer has a weight average molecular weight of about 500,000 Daltons.

* * * * *